United States Patent [19]

Farrington

[11] Patent Number: 4,467,978

[45] Date of Patent: Aug. 28, 1984

[54] REEL SYSTEM FOR SWIMMING POOL COVERS

[75] Inventor: Douglas I. Farrington, Hohokus, N.J.

[73] Assignee: Sealed Air Corporation, Fair Lawn, N.J.

[21] Appl. No.: 437,190

[22] Filed: Oct. 27, 1982

[51] Int. Cl.[3] ..... B65H 75/02; B65H 75/28; E04H 3/19

[52] U.S. Cl. ..... 242/86.52; 4/502; 242/68

[58] Field of Search ..... 384/440, 442, 444; 242/55, 86.52, 85, 86.5, 68, 73.5; 4/498, 500, 502, 503, 580; 29/119, 121.1, 123; 220/200; 293/27; 52/3; 308/245; 160/323 R, 323 B; 248/158, 159, 352, 161

[56] References Cited

U.S. PATENT DOCUMENTS

| | | | |
|---|---|---|---|
| 525,909 | 9/1894 | Klemm | 248/158 |
| 1,499,280 | 6/1924 | Alheit | 248/352 X |
| 3,008,343 | 11/1961 | Wasley | 308/245 |
| 3,062,381 | 11/1962 | Maiden | 160/327 X |
| 3,333,905 | 8/1967 | Henneguin | 384/440 |
| 3,747,132 | 7/1973 | Foster | 4/502 |
| 3,885,255 | 5/1975 | Vorbach et al. | 4/502 |
| 4,324,370 | 4/1982 | Guard et al. | 4/502 |
| 4,328,930 | 5/1982 | Kalendovsky | 242/55 |
| 4,402,305 | 9/1983 | Kremen | 4/503 |
| 4,407,027 | 10/1983 | Colon, Jr. | 4/502 |

*Primary Examiner*—Stuart S. Levy
*Assistant Examiner*—Leo J. Peters
*Attorney, Agent, or Firm*—Lerner, David, Littenberg, Krumholz & Mentlik

[57] ABSTRACT

A reel system for winding swimming pool covers thereabout is constructed from a hub having an opening for receiving one end of a spool to be attached thereto. The hub includes a bushing and a wheel for rotating the hub about its longitudinal axis. A support stand having a bearing is arranged for rotationally supporting the hub about the bushing. Ultraviolet exposure and contamination by chemical and dirt is prevented in the area of the bushing and bearing by a cover arranged for engagement with the hub between a first and second position. The first position is such that the cover is at least coextensive with the bushing and bearing to prevent their exposure while the second position being remote from the bushing and bearing to allow disassembling of the reel system.

15 Claims, 5 Drawing Figures

REEL SYSTEM FOR SWIMMING POOL COVERS

BACKGROUND OF THE INVENTION

The present invention relates in general to a reel system and, more particularly, to such a reel system for a swimming pool cover having means for preventing the exposure of its bushing and bearing members while permitting easy disassembly of the reel system for repair and maintenance, as well as to facilitate its transport and storage.

Outdoor swimming pools are increasingly becoming a source of both pleasure and recreation for the average affluent American family. For this reason, various systems have been designed and utilized for heating the swimming pool to a more comfortable level for further enjoyment. These systems have taken the form of solar heating systems, as well as, the more conventional heating system using a nonreusable energy source such as gas and oil. These heating systems have become more popular in the northern climates where they aid in extending the swimming season from early spring into late fall. However, one disadvantage in the use of a swimming pool, either heated or unheated, is where the daytime or nightime ambient temperature is lower than that of the swimming pool temperature. As a result of this condition, a great quantity of heat is lost from the swimming pool to the ambient air thereby causing a chilling drop in the swimming pool's temperature. When this condition occurs to a certain degree, the swimming pool's temperature is lower than that which is considered enjoyable for use by the average person. This thereby limits the extent to which such swimming pools may be used in the spring and fall, as well as during cool periods in the summer which are frequently found in northern climate.

This problem has been overcome to some extent by the use of a heated swimming pool. However, where the heating is accomplished using conventional heating sources such as a gas and oil, the costs of maintaining a comfortable water temperature in most cases is prohibitive, particularly in the spring and fall. To this end, swimming pool covers have been developed which are stretched out overlying the swimming pool to act as a thermal barrier in order to minimize the heat loss from the swimming pool under the above-noted conditions. To facilitate the use of these swimming pool covers, reel systems have been developed to which one end of the blanket may be attached and wound up in a coil. These reel systems are positioned adjacent one end of the swimming pool during the swimming season such that the pool blanket may be unwound therefrom and laid across the top of the swimming pool as desired. When the swimming pool is to be used, the reel system may be used to remove the swimming pool cover from the top of the swimming pool by winding it into a coil about the reel system.

These reel systems must be of rugged construction to withstand not only the mechanical stresses placed upon it during the winding and unwinding of the swimming pool cover, but also to prevent its failure due to attack by the various chemicals often employed in maintaining a swimming pool, as well as attack from the ultraviolet action of the sun which is most severe in the southern climates. Presently available reel systems are designed to include an exposed bushing rotationally supported by a bearing. Frequently, failure of these reel systems occurs at the rotationally interconnected bushing and bearing due to mechanical failure, as well as being attacked by chemicals and ultraviolet action. To date, there is unknown in the prior art a reel system which is constructed in a manner to adequately protect the rotationally interconnected bushing and bearing while permitting relatively easy disassembling of the reel system for repair and maintenance, as well as to facilitate its transport and storage. Accordingly, it can be appreciated that there is an unsolved need for a reel system for a swimming pool cover which is constructed and arranged in accordance with the present invention.

SUMMARY OF THE INVENTION

It is broadly an object of the present invention to provide a reel system for winding a swimming pool cover thereupon which overcomes or avoids one or more of the foregoing disadvantages resulting from the use of the above-mentioned prior art reel systems and, which fulfills the requirements of such a reel system in accordance with the objects of the present invention as set forth thereat. Specifically, it is within the contemplation of one aspect of the present invention to provide a floor supported reel system for winding a swimming pool cover upon an attached spool constructed and arranged to be readily disassembled for repair and maintenance.

A further object of the present invention is to provide a reel system having operational members protected from ultraviolet exposure thereby reducing deterioration of these members and lengthening their useful life.

A further object of the present invention is to provide a reel system which prevents dirt and dust from collecting in the operational members so as to reduce wear and abrasion of these members thereby increasing their useful life.

A still further object of the present invention is to provide a reel system that can be moved as a unit while permitting convenient disassembly for repair and maintenance.

Still further in accordance with the present invention there is provided a reel system which permits the spool upon which a swimming pool cover is wound to be lifted from its support bearings and separately transported to a remote storage area, such as a garage, thereby providing a significant mobility factor to the reel system.

A yet still further object of the present invention is to provide a reel system that can be manufactured from molded high density plastic material, such as polyethylene material at a lower cost than that of other metal reel systems.

In accordance with one embodiment of the present invention, there is provided a reel for rotating a spool comprising a hub having a means for attaching one end of the spool thereto, the hub including a portion about which the hub is rotationally supported, means for rotationally supporting the hub about the portion and a removable cover arranged at least coextensive with the portion.

In accordance with the above embodiment, the supporting means comprises a self-supporting stand having a bearing for rotationally supporting the hub about the portion and wherein the bearing is removable from its rotationally supporting arrangement with the portion of the hub upon the cover being moved from its coextensive arrangement with the portion.

In accordance with another embodiment of the present invention, there is provided a reel for winding a pool blanket upon a spool comprising a hub having an opening for receiving one end of the spool to be attached thereto, the hub includes a bushing and means for rotating the hub about the longitudinal axis of the bushing, a stand having a bearing for rotationally supporting the hub about the bushing, and a cover arranged for engagement with the hub between a first and second position, the first position being at least coextensive with the bushing and the second portion being remote from the bushing to allow removal of the bearing therefrom.

In accordance with the last mentioned embodiment, the cover includes means for removably locking the cover in the first position while allowing the cover to be moved to the second position upon sufficient force being exerted thereupon.

BRIEF DESCRIPTION OF THE DRAWINGS

The above description, as well as further objects, features and advantages of the present invention, will be more fully understood by reference to the following detailed description of a presently preferred, but nonetheless illustrative reel system for swimming pool cover in accordance with the present invention when taken in conjunction with the accompanying drawings, wherein.

DETAILED DESCRIPTION OF THE INVENTION

Figure 1:
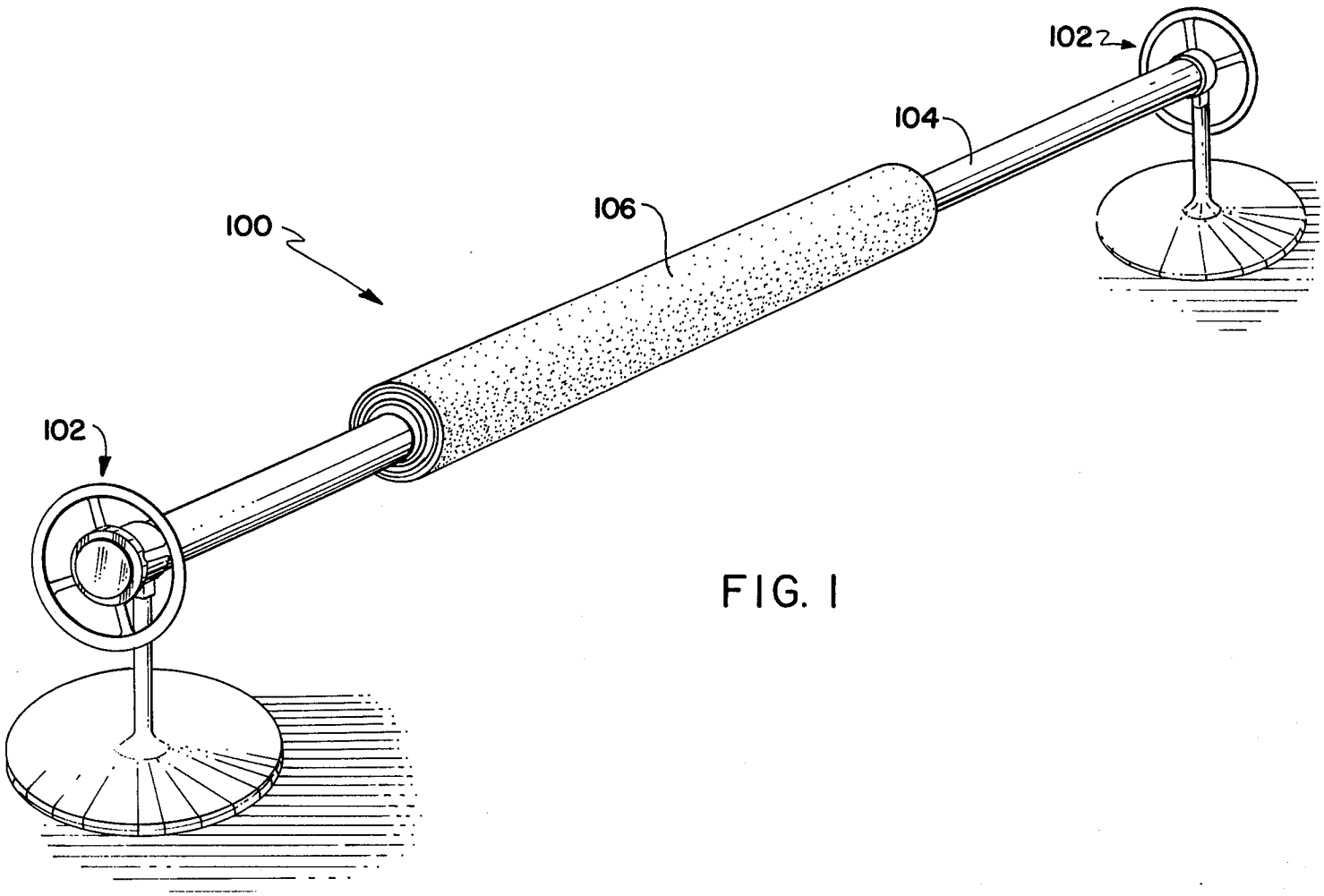
FIG. 1 is a perspective view of a reel system including a pair of spaced apart reels for rotationally supporting a spool upon which one or more swimming pool covers are wound thereabout.

Referring generally to the drawings wherein like reference numerals are applied to like elements, there is shown in FIG. 1 a perspective view of a reel system for swimming pool covers generally designated by reference numeral 100. Specifically referring to FIG. 1, the reel system 100 includes a pair of spaced apart reels 102 adapted for rotationally supporting a longitudinally extending spool 104 therebetween for winding one or more swimming pool covers 106 thereupon.

Figure 2:
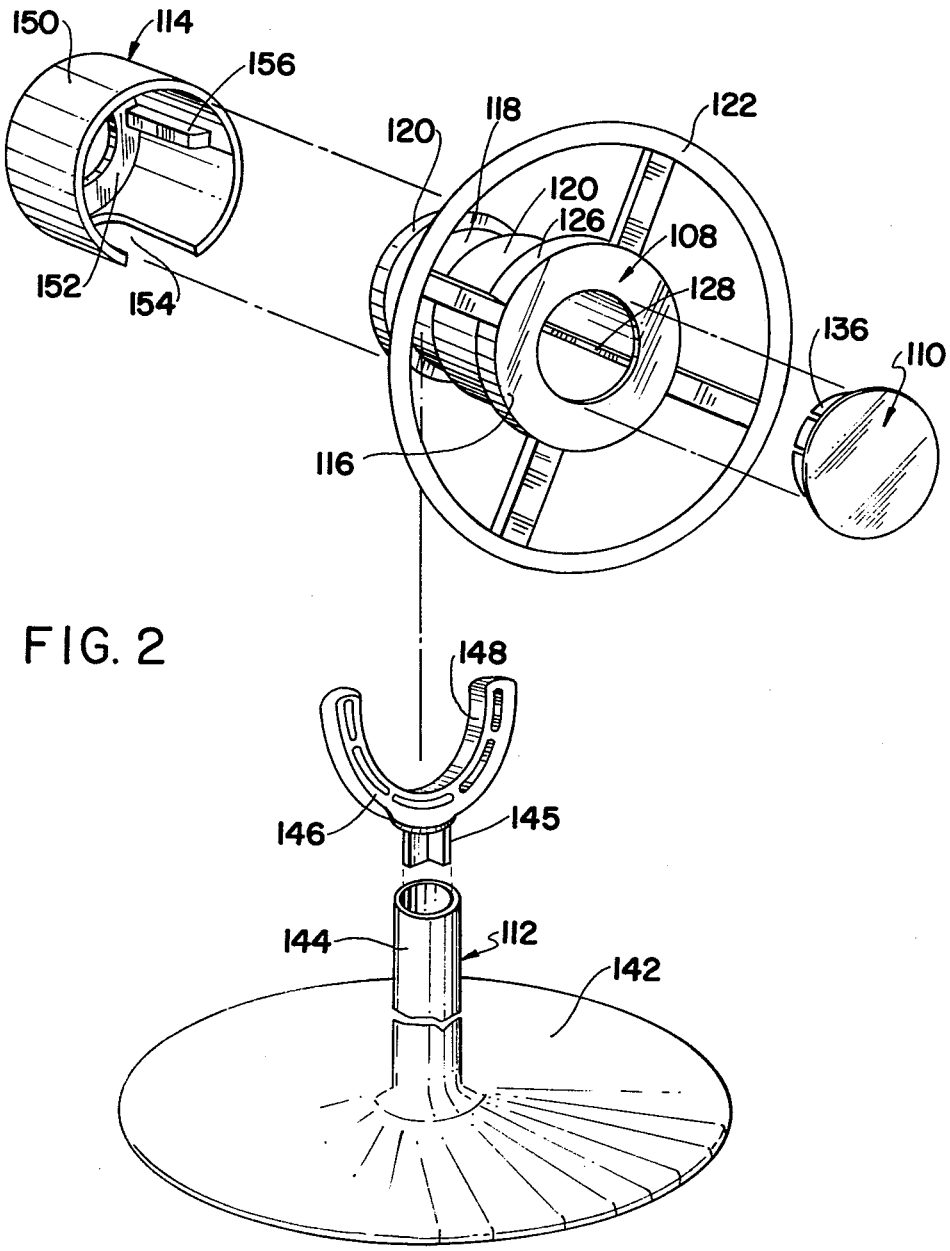
FIG. 2 is a perspective view showing each component of the reel system in accordance with the present invention in unassembled relationship including a cover, a hub having a bushing and wheel, a hub cap and a hub support stand having a U-shaped bearing thereon.
Figure 4:
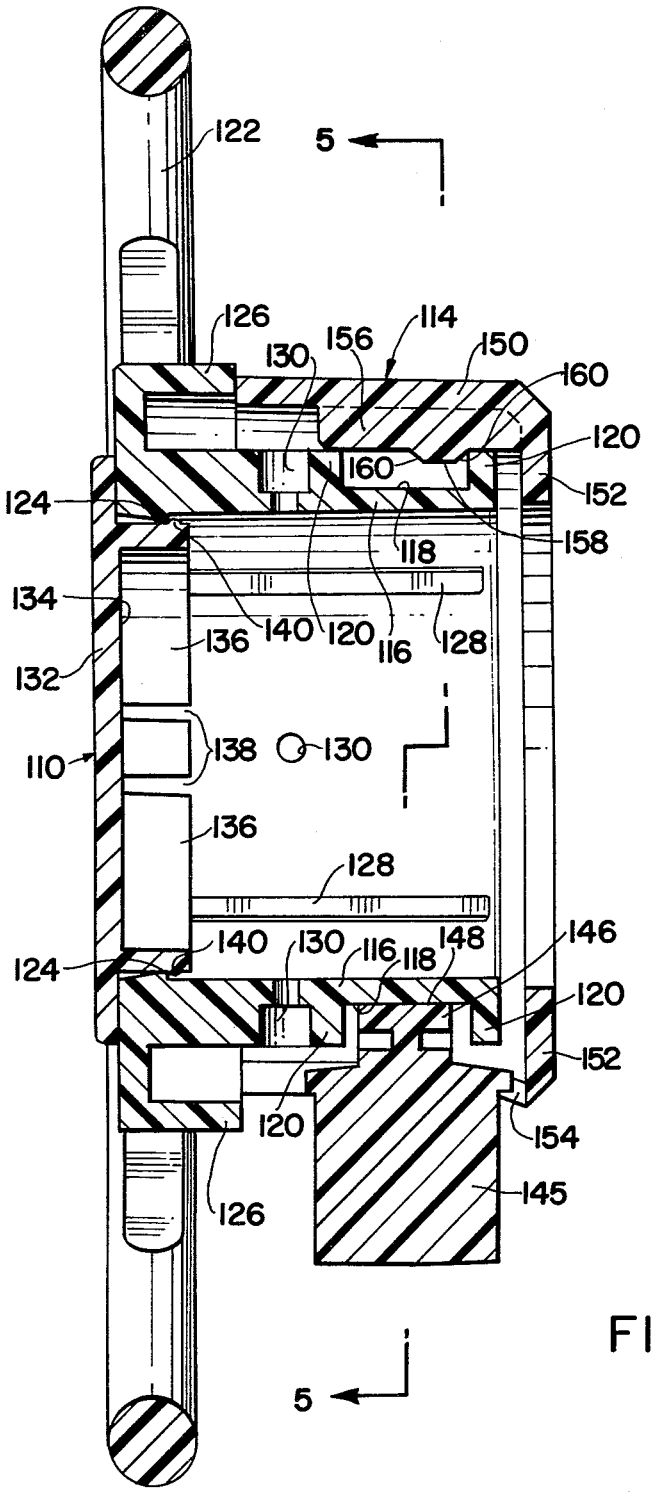
FIG. 4 is a cross-sectional elevation of the hub as illustrated in FIG. 2 showing it in assembled relationship, as well as being rotationally supported by the U-shaped bearing about the bushing of the hub; and, FIG. 5 is a front elevation of the hub in cross-section taken along Line 5—5 of FIG. 4 showing the U-shaped bearing supporting the bushing of the hub.

Referring to FIGS. 2 and 4, the reel 102 is constructed from a hub 108, a hub cap 110, a hub support stand 112 and a cover 114. The hub 108 is constructed from a hollow cylindrical section 116 being open at either end thereof. At one end of the hub 108 there is provided a circumferential surface portion or bushing 118 arranged between a pair of radial outwardly extending flanges 120. At the opposite end of the hub 108 there is provided a spoked hub wheel 122 arranged transverse to the longitudinal axis of the hub. At this opposite end, the hub is constructed to include along its interior a circumferential radial inwardly extending lip 124 and, about the exterior of the hub a circumferential radial outwardly extending stop member 126. A plurality of ribs 128 are provided longitudinally extending about the interior surface of the hub 108 and extending radial inwardly adapted to centrally position and guide the spool 104 within the hollow cylindrical section 116. A plurality of holes 130 are provided circumferentially about the hollow cylindrical section 116 communicating between the interior and exterior thereof for receiving a bolt or screw adapted to secure the spool 104 within the hollow cylindrical section.

The hub cap 110 is constructed of a flat circular disk 132 having an outer diameter greater than the inside diameter of the hollow cylindrical section 116. Extending from the rear surface 134 of the disk 132 are a plurality of tabs 136 spaced apart by openings 138 and arranged to form a circle. A ridge 140 is constructed on the outer surface of the tabs 136 adapted to engage behind the lip 124 of the hollow cylindrical section 116 as the hub cap 110 is positioned within the open end of the hub 108 adjacent the hub wheel 122.

Figure 5:
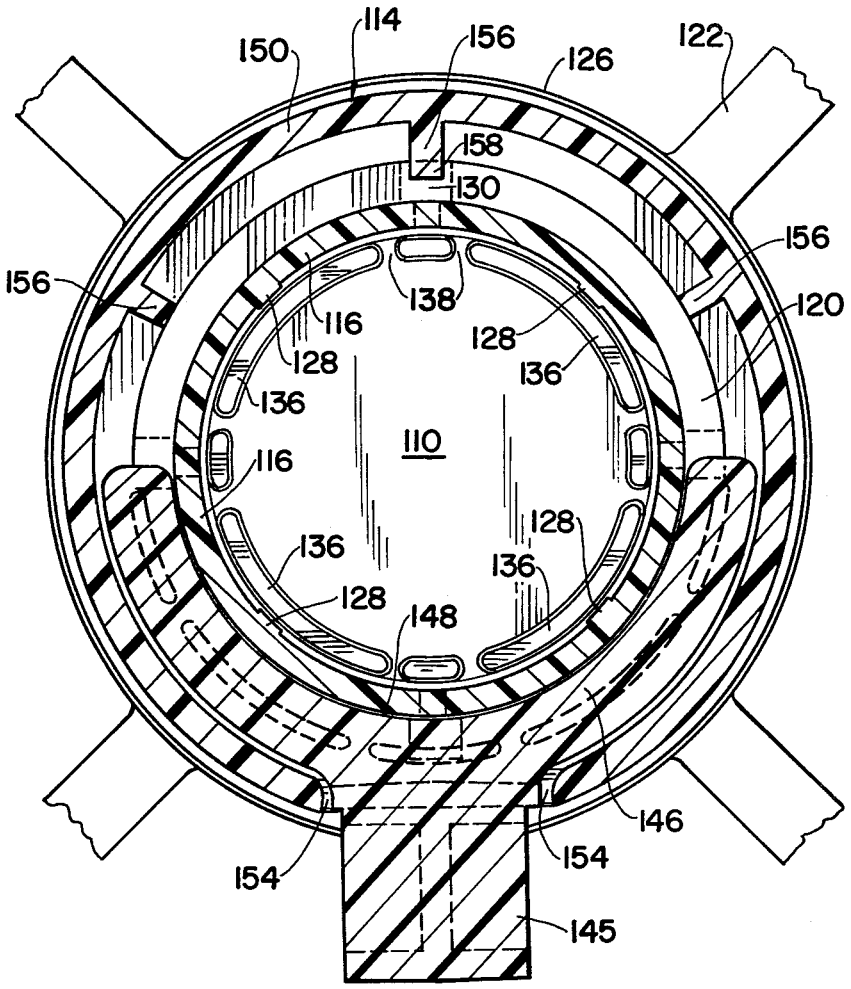

The hub support stand 112 is constructed from a self-supporting base 142 having a substantially vertically extending support pole 144. The end of the support pole 144 is provided with an opening adapted to receive by press fit the butt end 145 of a U-shaped bearing 146. The bearing 146 is provided with a smooth bearing surface 148 for rotationally supporting the bushing 118 of the hub 108 between the flanges 120. The legs of the U-shaped bearing 146 extend circumferentially approximately 180° about the bushing 118 as best shown in FIG. 5.

The cover 114 is constructed from a hollow cylindrical section 150 having at one end a radial inwardly extending flange 152 defining an opening of sufficient diameter to receive the spool 104 and having its other end of sufficient diameter to engage circumferentially about the exterior of the hub 108. A slot 154 is provided within the hollow cylindrical section 150 of sufficient width to receive the support pole 144 of the hub support stand 112. A plurality of guide ribs 156 are provided radial inwardly extending circumferentially about the interior of the hollow cylindrical section 150 of the cap 114. The radial inward extent of the ribs 156 is slightly less than or equal to the radial outward extent of the flanges 120 of the hub 108 such that the ribs support and center the cover 114 circumferentially about the hub coextensive with the bushing 118. One or more of the guide ribs 156 are provided with a protrusion 158 extending radial inwardly greater than the radial outward extent of the flanges 120 of the hub 108 as best shown in FIG. 4. The protrusion 158 is provided with a pair of opposed incline surfaces 160.

The assembling of the reel system 100 in accordance with the present invention will now be described with reference to FIGS. 3–5. A spool 104 of predetermined length is inserted within the hollow cylindrical section 116 of the hub 108 as guided by the ribs 128. The spool 104 is secured within the hollow cylindrical section 116 by means of a plurality of screws (not shown) arranged extending through the holes 130. The open end of the hub 108 adjacent the hub wheel 122 is closed via hub cap 110. As the hub cap 110 is inserted into the opening of the hub 108, the tabs 136 are slightly compressed inwardly by the provisions of the openings 138 such that the hub cap is removably secured to the hub by the ridges 140 engaging behind the lip 124 provided on the hollow cylindrical section 116 of the hub. In this regard, the hub cap 110 can be removed, if desired, to facilitate installation and removal of the spool 104 within the hub 108 or for repair and maintenance.

Figure 3:
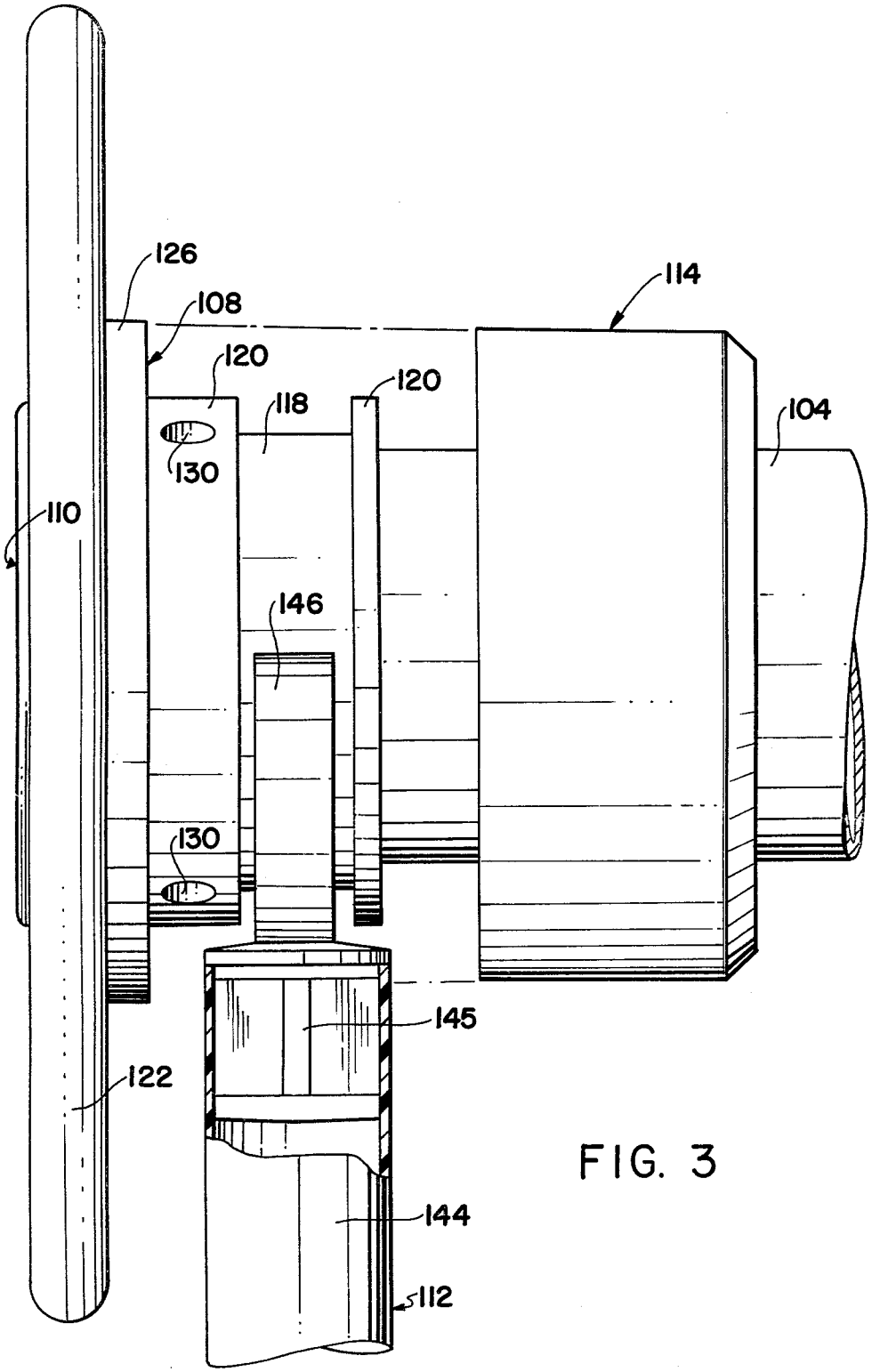
FIG. 3 is a side elevation of the reel system in accordance with the present invention illustrated in assembled relationship.

The hub 108, as now secured to either end of a spool 104, is positioned over the hub support stand 112 and lowered thereupon such that the U-shaped bearing 146 of the support stand circumferentially engages about the bushing 118 of the hub between the pair of flanges 120 as best shown in FIG. 3. The bearing surface 148 of the bushing 146 now is in intimate sliding contact with the bushing 118 for rotational support of the hub 108.

The cover 114 having previously been positioned along the spool 104 through the opening defined by the flanges 152, is now arranged concentric about and coextensive with the bushing 118 of the hub 108 and the bearing 146 of the hub support stand 112. The cover 114 is slid along the spool 104 and then circumferentially about the hollow cylindrical section 116 over the flanges 120 of the hub 108 due to their radial inward extent being less than the radial outward extent of the flanges. As the first flange 120 contacts the incline surface 160 of the protrusion 158, sufficient force is exerted on the cover 114 to cause the projection to ride over the flange and engage therebehind above the bushing 118 as illustrated in FIG. 4 to secure the cover to the hub 108. The longitudinal extent to which the cover 114 can coextensively engage the hub 108 is limited by the opened end of the cover abutting against the stop member 126 of the hub adjacent the hub wheel 122.

The reel 102 in accordance with the present invention in its assembled form as illustrated in FIG. 1 is aesthetically pleasing and of streamlined design. The reel 102 in its assembled relationship permits the transport of the reel system 100 as a unit to and from the swimming pool and storage area as desired. The cover 114, in addition to maintaining the reel 102 in assembled relationship, prevents dirt and dust from contacting the bushing 118 and bearing 146 thereby reducing wear and abrasion of these members, as well as preventing their exposure to ultraviolet light thereby reducing ultraviolet degradation and lengthening their useful life. In addition to the foregoing, should the reel 102 require disassembly or repair, the components of the reel may be easily disassembled for such repair or maintenance. In this regard, the cover 114 may be urged away from its coextensive engagement with the bushing 118 of the hub 108 and the bearing 146 of the hub support stand 112 by applying sufficient force thereto to overcome the engagement of the protrusion 158 on the guide rib 156 with the flange 120. With the cover 114 remote from the hub 108 as illustrated in FIG. 3, the spool 104 and hub 108 may be lifted off of its engagement with the bearing 146 for repair or replacement of the components of the reel 102. Further, with the cover 114 removed from its coextensive position with the hub 108, the spool 104 and attached hub 108 at either end thereof can be lifted from the hub support stand 112 and separately transported to a remote storage area thereby providing a significant mobility factor to the reel system 100 of the present invention. During transport of the spool 104, a further advantage of the reel system 100 of the present invention is that the cover 114 remain slidably engaged on the spool such that it cannot be lost or misplaced. Further, should the bearing 146 become worn out, it is relatively simple to remove the bearing from the support pole 144 and press fit a new bearing therein. Finally, as the hub cap 110 is easily removable from the hub 108, it provides ready access to the interior of the hub to facilitate repair as may be required.

There has thus far been described a floor supported reel for winding a pool blanket upon an attached spool in accordance with the present invention comprising a hub having an opening therethrough for receiving one end of the spool to be attached to the hub, the hub includes a bushing and a wheel adjacent the bushing for rotating the hub about the longitudinal axis of the bushing, a self-supporting stand having a U-shaped bearing for rotationally supporting the hub about the bushing, and a cover arranged for engagement with the hub between a first and second position, the first position being concentric about and coextensive with the bushing to prevent exposure of the bushing and the bearing and the second position being remote from the bushing to allow removal of the stand from rotationally supporting the bushing by the bearing.

Although the invention herein has been described with reference to particular embodiments, it is to be understood that these embodiments are merely illustrative of the principles and applications of the present invention. For example, although not previously described, the length of the spool 104 may be of any length desired and, in fact, can be made adjustable. That is, the spool 104 can be constructed of two spools 104 of equal diameter connected by a sleeve segment of greater diameter and adapted to receive either end of the spool therein and to be secured thereto by suitable bolts or other means. It is therefore to be understood that numerous modification may be made in the illustrative embodiments and that other embodiments may be devised without departing from the spirit and scope of the present invention as defined by the appended claims.

What is claimed is:

1. A reel for rotating a spool comprising, a hub having means for attaching one end of said spool thereto, said hub including a portion about which said hub is rotationally supported, supporting means for rotationally supporting said hub about said portion, and a cover arranged for engagement with said hub moveable between a first and second position, said cover in said first position covering said portion, and said cover in said second position being remote from said portion to allow removal of said hub from said supporting means.

2. The reel as set forth in claim 1 wherein said hub further includes means for rotating said hub about its longitudinal axis.

3. The reel as set forth in claim 1 wherein said portion comprises a bushing arranged along said hub between a pair of flanges.

4. The reel as set forth in claim 1 wherein the supporting means comprises a self-supporting stand having a bearing for rotationally supporting said hub about said portion.

5. The reel as set forth in claim 4 wherein said bearing is removable from its rotationally supporting arrangement with said portion of said hub upon said cover being moved from its first position to its second position.

6. The reel as set forth in claim 1 wherein said cover includes means for removably locking said cover into engagement with said hub when in said first position.

7. A reel for winding a pool blanket upon a spool comprising, a hub having an opening for receiving one end of said spool to be attached thereto, said hub including a bushing and means for rotating said hub about the longitudinal axis of said bushing, a stand having a bearing for rotationally supporting said hub about said bushing, and a cover arranged for engagement with said hub and movable between a first and second position, said cover in said first position covering said bushing and said bearing, and said cover in second position being remote from said bushing to allow removal of said bearing therefrom.

8. The reel as set forth in claim 7 wherein said hub further includes a cap for closing one end of said opening.

9. The reel as set forth in claim 7 wherein said bushing is arranged between a pair of flanges and the rotating means is arranged adjacent one of said flanges.

10. The reel as set forth in claim 7 wherein said bearing is of U-shape.

11. The reel as set forth in claim 7 wherein said cover includes means for locking said cover in said first position while allowing said cover to be moved to said second position upon sufficient force being exerted thereupon.

12. A floor supported reel for winding a swimming pool cover upon an attached spool comprising, a hub having an opening therethrough for receiving one end of said spool to be attached to said hub, said hub including a bushing and a wheel adjacent said bushing for rotating said hub about the longitudinal axis of said bushing, a self-supporting stand having a U-shaped bearing for rotationally supporting said hub about said bushing, and a cover arranged for engagement with said hub and movable between a first and second position, said first position being concentric about and covering said bushing to prevent exposure of said bushing and said bearing and said second position being remote from said bushing to allow removal of said stand from rotationally supporting said bushing by said bearing.

13. The reel as set forth in claim 12 wherein said hub includes a cap for closing one end of said opening adjacent said wheel.

14. The reel as set forth in claim 12 wherein said cover is arranged for sliding engagement along said spool when in said second position.

15. The reel as set forth in claim 12 further including a swimming pool cover attached to said spool.

* * * * *